US009746296B2

(12) United States Patent
Kraft et al.

(10) Patent No.: US 9,746,296 B2
(45) **Date of Patent: *Aug. 29, 2017**

(54) CUSTOMIZABLE PROJECTILE DESIGNED TO TUMBLE

(71) Applicant: WARD KRAFT, INC., Fort Scott, KS (US)

(72) Inventors: Ryan Kraft, Fort Scott, KS (US); Gary Buntain, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/367,523

(22) Filed: Dec. 2, 2016

(65) Prior Publication Data

US 2017/0074627 A1 Mar. 16, 2017

Related U.S. Application Data

(63) Continuation of application No. 14/604,002, filed on Jan. 23, 2015, now Pat. No. 9,541,362.

(60) Provisional application No. 61/931,362, filed on Jan. 24, 2014.

(51) Int. Cl.

| | |
|---|---|
| ***F42B 12/02*** | (2006.01) |
| ***F42B 30/02*** | (2006.01) |
| ***F42B 33/00*** | (2006.01) |

(52) U.S. Cl.

CPC ..... *F42B 12/02* (2013.01); *F42B 30/02* (2013.01); *F42B 33/001* (2013.01)

(58) Field of Classification Search

USPC ..... 102/501, 517, 514, 519

See application file for complete search history.

(56) References Cited

U.S. PATENT DOCUMENTS

| | | | | |
|---|---|---|---|---|
| 3,949,677 | A | 4/1976 | Voss | |
| 4,836,108 | A | 6/1989 | Kegel et al. | |
| 5,652,407 | A | 7/1997 | Carbone | |
| 5,767,438 | A | 6/1998 | Lang et al. | |
| 5,798,478 | A | 8/1998 | Beal | |
| 6,305,293 | B1 | 10/2001 | Fry et al. | |
| 6,439,125 | B1 * | 8/2002 | Carter | F42B 5/025 102/507 |
| 7,300,357 | B2 | 11/2007 | Breaker et al. | |
| 7,455,015 | B2 | 11/2008 | Krstic | |
| 7,741,588 | B2 | 6/2010 | Gundel et al. | |
| 7,748,325 | B2 | 7/2010 | Marx | |
| 7,874,253 | B2 | 1/2011 | Marx | |
| 7,980,180 | B2 | 7/2011 | MacDougall | |
| 8,176,850 | B2 | 5/2012 | Thompson et al. | |
| 8,783,187 | B2 | 7/2014 | Amick | |
| 8,893,621 | B1 * | 11/2014 | Escobar | F42B 10/44 102/501 |

* cited by examiner

*Primary Examiner* — J. Woodrow Eldred
(74) *Attorney, Agent, or Firm* — Lathrop Gage LLP

(57) ABSTRACT

A method of making a projectile that tumbles upon impact. The projectile has a leading portion, a leading portion trailing end, and a leading portion side which forms a leading portion acute angle with the leading portion trailing end. A tip extends from the leading portion and has a tip trailing end and a tip side. The tip side forms a tip acute angle with the tip trailing end.

16 Claims, 3 Drawing Sheets

CUSTOMIZABLE PROJECTILE DESIGNED TO TUMBLE

RELATED APPLICATIONS

This application is a continuation of U.S. application Ser. No. 14/604,002, filed Jan. 23, 2016, which claims priority to U.S. Provisional Application No. 61/931,362 filed Jan. 24, 2014. The disclosure of each is incorporated herein by reference in its entirety.

FIELD OF INVENTION

The field of the invention is projectiles for use in cartridges fired from handguns and other firearms.

BACKGROUND OF INVENTION

Projectiles, or bullets, are made in a variety of shapes and sizes depending upon their intended use. The shape and size of a projectile affects the kinetic energy that is transferred to a target upon impact. The kinetic energy of a discharged projectile will be a function of its mass and its velocity via the well-known formula Kinetic Entergy (KE)=½ (mass)(velocity)(velocity). Often, as is the case in hunting, it is desirable to maximize the kinetic energy transferred by the projectile, thus increasing its lethality.

Most projectiles that are designed to maximize lethality suffer from various shortcomings. Expanding projectiles and fragmenting projectiles, for example, succeed in causing an increased amount of damage to a target, compared to the average projectile. However, expanding and fragmenting projectiles frequently transfer an inadequate amount of energy to the target. Further, expanding and fragmenting projectiles are generally difficult to control and, thus, produce inconsistent results.

Projectiles that are designed to tumble typically transfer a higher amount of kinetic energy than those previously discussed. A problem observed with prior art designs for tumbling projectiles is the inability to control how and when the projectile tumbles.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

The present disclosure comprises designs for a projectile, or bullet, which tumbles upon impact with a target. The design of the projectile may be tailored to the specification of the shooter or designer for a specific target so as to create an optimal energy release at an optimal depth in the target, thus increasing the efficiency. The projectile is generally made of copper or similar material. However, any type of metal, composite, or combination thereof may be used.

According to an embodiment, a method of making a second projectile that, upon firing, exhibits increased tumbling relative to a first projectile is disclosed. The first projectile comprises a first projectile leading portion, a first projectile leading portion trailing end, and a first projectile leading portion side which forms a first projectile leading portion acute angle with the first projectile leading portion trailing end. The first projectile further includes a first projectile pointed tip which extends from the first projectile leading portion. The first projectile tip has a first projectile tip trailing end and a first projectile tip side. The first projectile tip side forms a first projectile tip acute angle with the first projectile tip trailing end. The projectile includes a first projectile middle portion, and a first projectile base portion which extends rearwardly from the first projectile middle portion. The method comprises the step of providing the second projectile. The second projectile comprises a second projectile leading portion, a second projectile leading portion trailing end, and a second projectile leading portion side forming a second projectile leading portion acute angle with the second projectile leading portion trailing end. The second projectile includes a second projectile pointed tip which extends from the second projectile leading portion and has a second projectile tip trailing end and a second projectile tip side. The second projectile tip side forms a second projectile tip acute angle with the second projectile tip trailing end. The second projectile includes a middle portion, and a second projectile base portion which extends rearwardly from the second projectile middle portion. A length of the second projectile leading portion side is greater than a length of the first projectile leading portion side.

According to another embodiment, a method of making a second projectile that, upon firing, exhibits increased tumbling relative to a first projectile is disclosed. The first projectile comprises a first projectile leading portion, a first projectile leading portion trailing end, and a first projectile leading portion side forming a first projectile leading portion acute angle with the first projectile leading portion trailing end. The first projectile has first projectile tip extending from the first projectile leading portion, and the tip has a first projectile tip trailing end and a first projectile tip side. The first projectile tip side forms a first projectile tip acute angle with the first projectile tip trailing end. The first projectile includes a first projectile middle portion and a first projectile base portion which extends rearwardly from the first projectile middle portion. The method includes the step of providing the second projectile. The second projectile has a second projectile leading portion, a second projectile leading portion trailing end, and a second projectile leading portion side which forms a second projectile leading portion acute angle with the second projectile leading portion trailing end. The second projectile includes a second projectile tip extending from the second projectile leading portion and has a second projectile tip trailing end and a second projectile tip side. The second projectile tip side forms a second projectile tip acute angle with the second projectile tip trailing end. The second projectile includes a second projectile middle portion, and a second projectile base portion which extends rearwardly from the second projectile middle portion. The second projectile tip acute angle is sharper than the first projectile tip acute angle.

According to yet another embodiment, a method of making a second projectile that, upon firing, exhibits increased tumbling relative to a first projectile is disclosed. The first projectile comprises a first projectile leading portion, a first projectile leading portion trailing end, and a first projectile leading portion side which forms a first projectile leading portion acute angle with the first projectile leading portion trailing end. The first projectile has a first projectile tip extending from the first projectile leading portion. The tip has a first projectile tip trailing end and a first projectile tip side. The first projectile tip side forms a first projectile tip acute angle with the first projectile tip trailing end. The method comprises the step of providing the second projectile. The second projectile has a second projectile leading portion, a second projectile leading portion trailing end, and a second projectile leading portion side which forms a second projectile leading portion acute angle with the second projectile leading portion trailing end. A second projectile tip extends from the second projectile leading portion and has a second projectile tip trailing end and a second projectile tip side. The second projectile tip side forms a second projectile tip acute angle with the second projectile tip trailing end. In the second projectile, at least one of the following conditions is met: the second projectile tip acute angle is sharper than the first projectile tip acute angle, and/or a length of the second projectile leading portion side is greater than a length of the first projectile leading portion side.

DETAILED DESCRIPTION OF THE INVENTION

Figure 1:
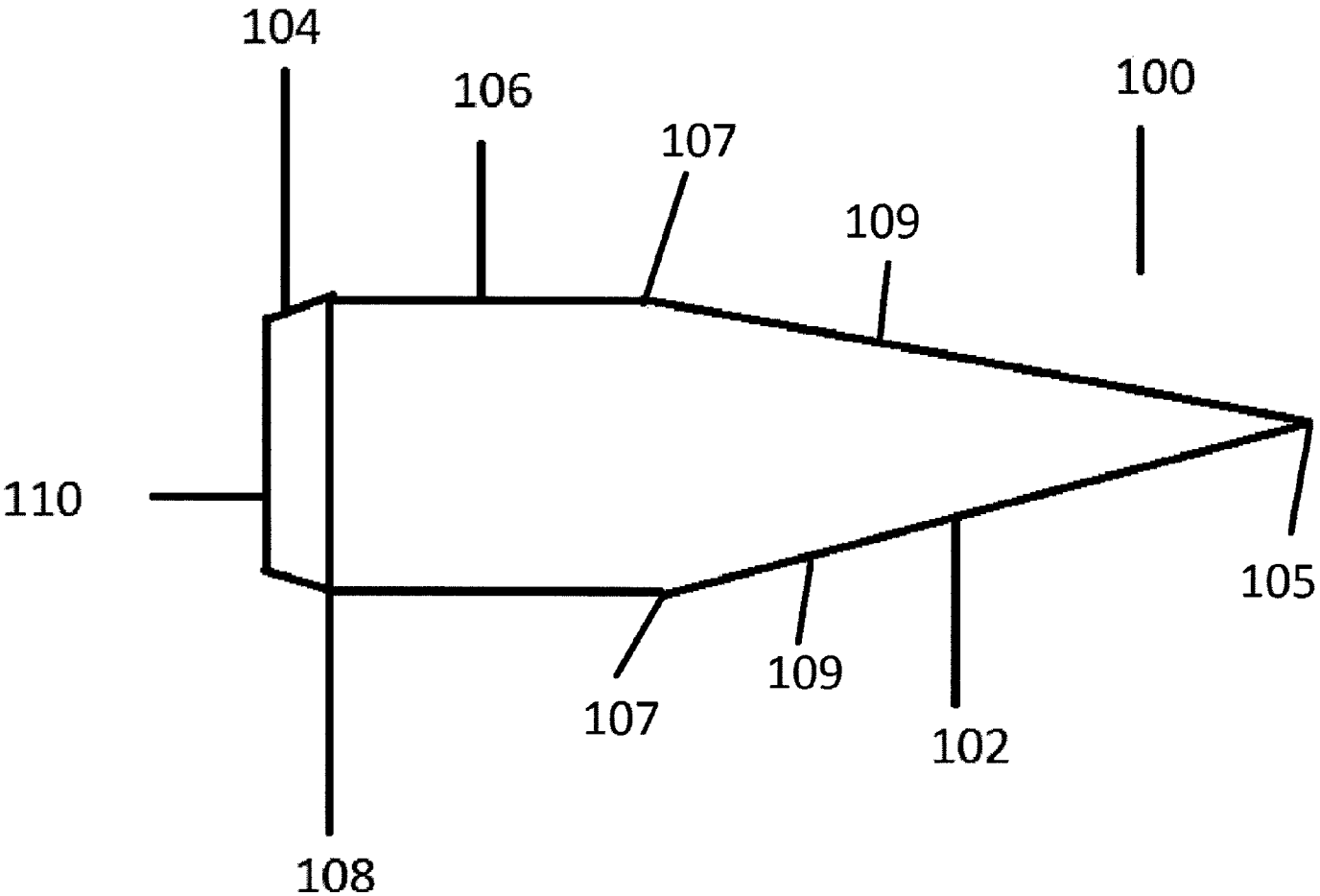
FIG. 1 is a schematic cross-sectional view of one embodiment of a projectile used in a firearm, according to the invention.

FIG. 1 shows a schematic cross-sectional view of one embodiment 100 of projectile. The projectile 100 is generally cylindrical shaped with a first portion 102 extending from a second or middle portion 106 of the projectile 100 to form a point 105 at a leading end of the projectile 100. The first portion 102 has a trailing end 107 and a first portion side 109. The first portion trailing end 107 may just designate the location along the length of the projectile 100 where the diameter of the projectile 100 begins to decrease, thus tapering the projectile 100 in the direction of its leading end. The second portion 106 generally has a larger diameter than the first portion 102, although the second portion 106 may vary in diameter and length. The third portion 104, which makes up the base of the projectile 100, extends from the second portion 106, opposite the first portion 102. The diameter of the third portion 104 generally tapers as it extends away from the second portion 106. The first side 108 of the third portion 104 is generally the same diameter as the second portion 106. The diameter of the second side or trailing end 110 of the third portion 104 is generally smaller than that of the first side 108.

The tumbling of the projectile 100 may be controlled by changing the length of the first portion side 109 from the trailing end 107 to the point 105. Increasing such length causes the projectile 100 to begin to tumble very close to or at the target. Decreasing such length causes the projectile 100 to begin to tumble farther from the point of impact. The tumbling of the projectile 100 may also be controlled by flattening the point 105 so that there is a flat surface (not shown) at the leading end or point 105 of the projectile 100. Increasing the diameter of such flat surface causes the projectile to begin to tumble farther from the target, whereas decreasing the diameter of such flat surface causes the projectile to begin to tumble close to or at the target.

Figure 4:
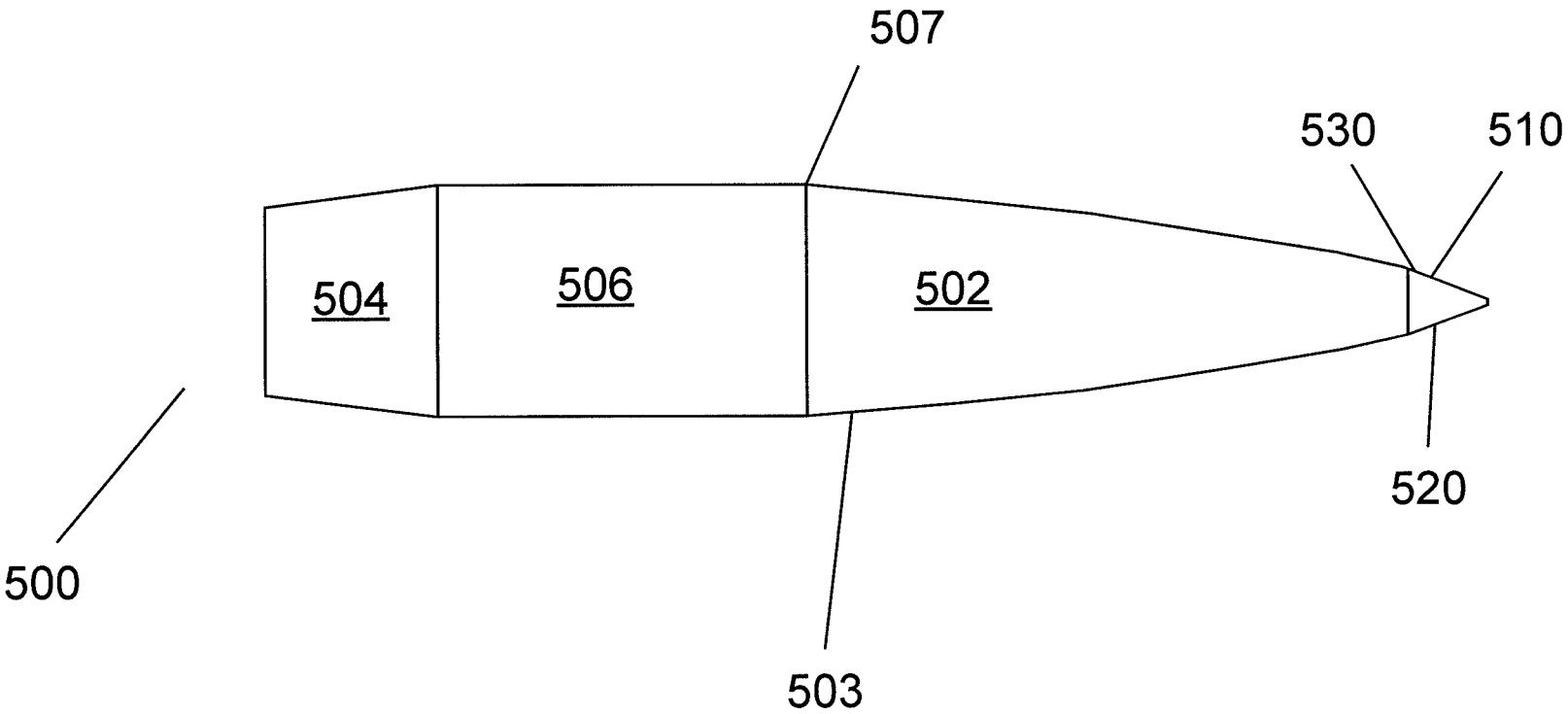
FIG. 4 is a schematic of a cross-sectional view of a projectile according to an embodiment of the present invention.

FIG. 4 shows a second embodiment 500 of a projectile according to the invention.

The projectile 500 has a first (or leading) portion 502, a first portion side 503, a base 504, a mid-portion 506, a first portion trailing end 507, a pointed tip 510 at a leading end of the projectile 500, a tip side 520, and a tip trailing end 530. The first portion trailing end 507 and the tip trailing end 530 may not be two specific surfaces or disconnected from the part from which they extend. The first portion trailing end 507 and the tip trailing end 530 may just designate the location along the length of the projectile 500 where the diameter of the projectile 500 begins to decrease, thus tapering the projectile 500 in the direction of its leading end. It will be noted that the first portion side 503 forms an acute angle with the first portion trailing end 507, and that the tip side 520 forms a second more acute angle with the tip trailing end 530. The addition of the tip 510 and its second, more acute (sharper) angle with respect to the tip trailing end 530 (and also more acute than the angle between the first portion side 503 and the first portion trailing end 507) causes the projectile 500 to tumble after it impacts a target.

When a projectile impacts a target it releases energy which can be observed as a cavitation in ballistic gel. The cavitation in ballistic gel represents damage that would be caused to the tissue if the projectile 100 or 500 impacted a living target. As the projectile 100 or 500 begins to tumble, an increased amount of energy is released. The design of the projectile 500 may be tailored to the specification of the shooter or designer. The specifications that may be changed to affect the performance of the projectile (i.e. larger cavitation) include a sharper or more acute angle between the tip side 520 and the trailing end 530 of the tip 510, the radius of the first portion 502, the diameter of the point of the nose, the width or diameter of the mid-portion 506, the speed of the projectile 500 when fired from the firearm, and the width or diameter of the base 504. It was found that, if the more acute (sharper) angle between the tip side 520 and the tip trailing end 530 is placed at the forward end of the projectile, as shown in projectile 500, the projectile will tumble early and continue to tumble through the target. If the length of the first portion side 503 is increased the projectile will tumble, and the tumbling of the projectile 500 will increased in frequency as the length of the first portion 503 is increased. However, as the length of the first portion side 503 is decreased, the projectile is less likely to tumble, and further shortening the first portion side 503 can prevent the projectile from tumbling at all. It should also be noted that by changing certain aspects of the design, such as length of the tip, for example, performance may be affected in ways other than just tumbling. For example, the yaw or roll of the bullet may be affected by such changes. Thus, a projectile manufacturer may use the techniques outlined herein to increase (or decrease) tumbling, or vary other characteristics of a projectile, as compared to another projectile (e.g., a prior art projectile, or relative to a projectile disclosed herein).

Figure 2:
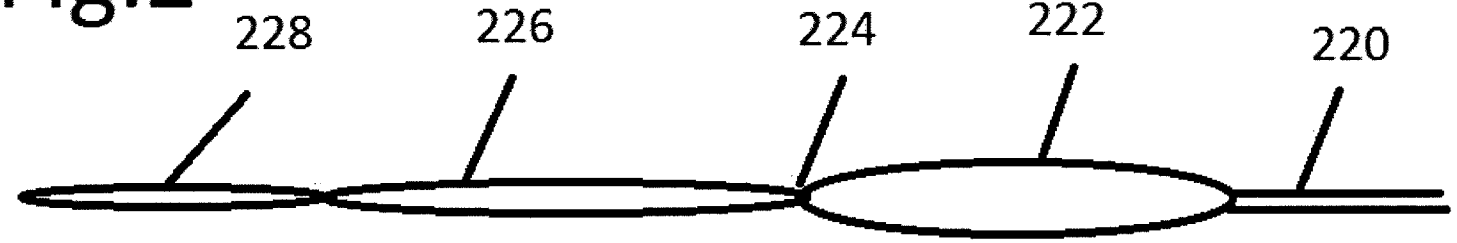
FIG. 2 is a schematic showing the motion of a projectile, according to a prior art design, fired into ballistic gel.

FIG. 2 shows the motion of a projectile, according to prior art designs, fired into ballistic gel. As the projectile enters the ballistic gel it creates a steady channel 220 prior to tumbling. As the projectile tumbles it creates the first cavitation 222. It immediately tumbles a second time, creating a second cavitation 226. After the second cavitation 226, the projectile creates another steady channel 228 until it stops.

Figure 3:
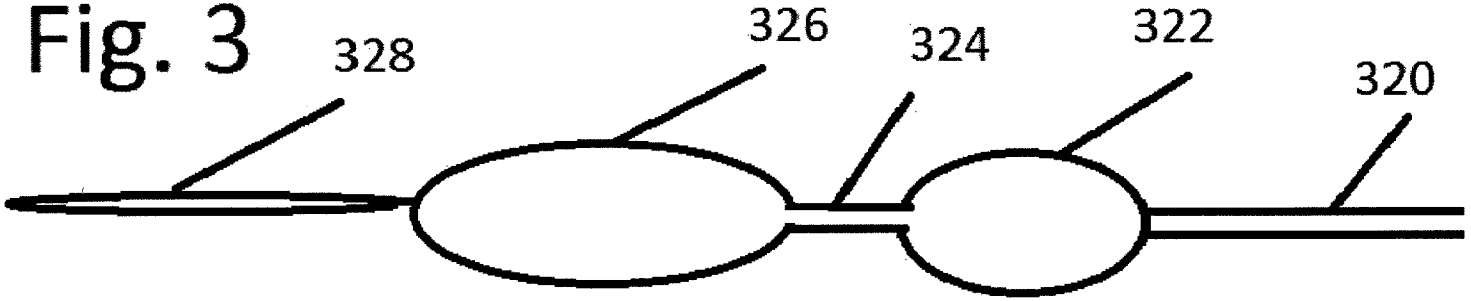
FIG. 3 is a schematic showing the motion of a projectile, according to a second embodiment of the present invention, fired into ballistic gel.

FIG. 3 shows the motion of a projectile according to the embodiment 500 of FIG. 4 fired into ballistic gel. As the projectile enters the ballistic gel it creates a steady channel 320 prior to tumbling. As the projectile tumbles it creates the first cavitation 322. It then creates a short steady channel 324 before it tumbles a second time, creating a second cavitation 326. After the second cavitation 326, the projectile creates another steady channel 328 until it stops.

The table below summarizes the measurements of the motion of the projectiles discussed in FIGS. 2 and 3:

| | Length of channel prior to first cavitation | Length of first cavitation | Length between first and second cavitation | Length of second cavitation | Length of channel following second cavitation | Total length of channel |
|---|---|---|---|---|---|---|
| FIG. 2 | 1.5" | 3" | 0 | 2" | 5.5" | 12" |
| FIG. 3 | 3" | 2.5" | 1.25" | 5.25" | 6" | 18" |

The data shown in the table above demonstrates the benefits of the present invention. Compared to the projectile in FIG. 2, the embodiment 500 of the present invention whose cavitation patterns are shown in FIG. 3 transferred an increased amount of energy to the target and did so in a more efficient manner. As shown in FIG. 3, the embodiment 500 of the present invention create, in total, longer channels (18 inches) in the target than the prior art design projectile of FIG. 2 (12 inches). As well, the cavitation in FIG. 3 is larger than that in FIG. 2 which signifies an increased amount of damage caused to the target. Moreover, the embodiment 500 is more lethal and, thus, more humane when used to hunt. Projectiles such as 500 have been found to tumble more dramatically when they impact a viscous object, such as an animal organ, than if they impact something more solid such as wood or metal. This feature is more prominent with embodiments such as 500 than with others known to be available, including those that tumble.

The invention claimed is:

1. A method of making a second projectile that, upon firing, exhibits increased tumbling relative to a first projectile, the first projectile comprising a first projectile leading portion, a first projectile leading portion trailing end, and a first projectile leading portion side forming a first projectile leading portion acute angle with the first projectile leading portion trailing end, a first projectile pointed tip extending from the first projectile leading portion and having a first projectile tip trailing end and a first projectile tip side, the first projectile tip side forming a first projectile tip acute angle with the first projectile tip trailing end, the first projectile tip acute angle being sharper than the first projectile leading portion acute angle, a first projectile middle portion, the first projectile middle portion being cylindrical and extending rearwardly from the first projectile leading portion, and a first projectile base portion extending rearwardly from the first projectile middle portion, the first projectile base portion being frustoconical, the method comprising:

providing the second projectile, comprising:

a second projectile leading portion, a second projectile leading portion trailing end, and a second projectile leading portion side forming a second projectile leading portion acute angle with the second projectile leading portion trailing end, a second projectile pointed tip extending from the second projectile leading portion and having a second projectile tip trailing end and a second projectile tip side, the second projectile tip side forming a second projectile tip acute angle with the second projectile tip trailing end, the second projectile tip acute angle being sharper than the second projectile leading portion acute angle, a second projectile middle portion, the second projectile middle portion being cylindrical and extending rearwardly from the second projectile leading portion, and a second projectile base portion extending rearwardly from the second projectile middle portion, the second projectile base portion being frustoconical;

wherein, a length of the second projectile leading portion side is greater than a length of the first projectile leading portion side.

2. The method of claim 1, wherein the second projectile is made of composite materials.

3. The method of claim 1, wherein the second projectile terminates at a continuous vertical wall at a rear of the second projectile base portion.

4. A method of making a second projectile that, upon firing, exhibits increased tumbling relative to a first projectile, the first projectile comprising a first projectile leading portion, a first projectile leading portion trailing end, and a first projectile leading portion side forming a first projectile leading portion acute angle with the first projectile leading portion trailing end, a first projectile tip extending from the first projectile leading portion and having a first projectile tip trailing end and a first projectile tip side, the first projectile tip side forming a first projectile tip acute angle with the first projectile tip trailing end, the first projectile tip acute angle being sharper than the first projectile leading portion acute angle, a first projectile middle portion, the first projectile middle portion being cylindrical and extending rearwardly from the first projectile leading portion, and a first projectile base portion extending rearwardly from the first projectile middle portion, the method comprising:

providing the second projectile, comprising:

a second projectile leading portion, a second projectile leading portion trailing end, and a second projectile leading portion side forming a second projectile leading portion acute angle with the second projectile leading portion trailing end, a second projectile tip extending from the second projectile leading portion and having a second projectile tip trailing end and a second projectile tip side, the second projectile tip side forming a second projectile tip acute angle with the second projectile tip trailing end, the second projectile tip acute angle being sharper than the second projectile leading portion acute angle, a second projectile middle portion, the second projectile middle portion being cylindrical and extending rearwardly from the second projectile leading portion, and a second projectile base portion extending rearwardly from the second projectile middle portion;

wherein, the second projectile tip acute angle is sharper than the first projectile tip acute angle.

5. The method of claim 4, wherein the tip of the second projectile is a pointed tip.

6. The method of claim 5, wherein the second projectile base portion is frustoconical.

7. The method of claim 4, wherein a length of the second projectile leading portion side is greater than a length of the first projectile leading portion side.

8. A method of making a second projectile that, upon firing, exhibits increased tumbling relative to a first projectile, the first projectile comprising a first projectile leading portion, a first projectile leading portion trailing end, and a first projectile leading portion side forming a first projectile leading portion acute angle with the first projectile leading portion trailing end, a first projectile tip extending from the first projectile leading portion and having a first projectile tip trailing end and a first projectile tip side, the first projectile tip side forming a first projectile tip acute angle with the first projectile tip trailing end, the first projectile tip acute angle being sharper than the first projectile leading portion acute angle, a first projectile middle portion, the first projectile middle portion being cylindrical and extending rearwardly from the first projectile leading portion, and a first projectile base portion extending rearwardly from the first projectile middle portion, the method comprising:

providing the second projectile, comprising:

a second projectile leading portion, a second projectile leading portion trailing end, and a second projectile leading portion side forming a second projectile leading portion acute angle with the second projectile leading portion trailing end, a second projectile tip extending from the second projectile leading portion and having a second projectile tip trailing end and a second projectile tip side, the second projectile tip side forming a second projectile tip acute angle with the second projectile tip trailing end, the second projectile tip acute angle being sharper than the second projectile leading portion acute angle, a second projectile middle portion, the second projectile middle portion being cylindrical and extending rearwardly from the second projectile leading portion, and a second projectile base portion extending rearwardly from the second projectile middle portion;

wherein, at least one of:

the second projectile tip acute angle is sharper than the first projectile tip acute angle; and a length of the second projectile leading portion side is greater than a length of the first projectile leading portion side.

9. The method of claim 8 wherein the second projectile base portion is frustoconical.

10. The method of claim 8 wherein the second projectile base portion terminates at a rear side in a solitary vertical plane defined by a vertical wall.

11. The method of claim 8 wherein a length of the second projectile middle portion is less than a length of the second projectile leading portion.

12. The method of claim 8 wherein the second projectile is made of composite materials.

13. The method of claim 1, wherein the length of the second projectile leading portion side is greater than a length of the second projectile middle portion.

14. The method of claim 13, wherein the length of the second projectile middle portion is greater than a length of the second projectile base portion.

15. A method of making a projectile configured to tumble upon impact, the method comprising:

providing a projectile, the projectile comprising a first portion having a first length, a first portion side and a first portion trailing end, the first portion side forming a first acute angle with the first portion trailing end, a tip extending forwardly from the first portion, the tip having a tip trailing end and a tip side, the tip side forming a second acute angle with the tip trailing end, the second acute angle being sharper than the first acute angle, a second portion extending rearwardly from the first portion, the second portion being cylindrical and having a second length that is less than the first length, and a frustoconical base portion extending rearwardly from the second portion.

16. The method of claim 15, wherein the base portion has a third length that is less than the second length.

* * * * *